US010227204B2

(12) United States Patent
Reese et al.

(10) Patent No.: US 10,227,204 B2
(45) Date of Patent: Mar. 12, 2019

(54) CAPSTAN AND SYSTEM OF CAPSTANS FOR USE IN SPOOLING MULTIPLE CONDUCTORS ONTO A SINGLE REEL

(71) Applicant: Southwire Company, LLC, Carrollton, GA (US)

(72) Inventors: Charlie W. Reese, Carrollton, GA (US); Donald E. Murphy, Douglasville, GA (US); Albert Elder, Buchanan, GA (US)

(73) Assignee: Southwire Company, LLC, Carrollton, GA (US)

( * ) Notice: Subject to any disclaimer, the term of this patent is extended or adjusted under 35 U.S.C. 154(b) by 0 days.

(21) Appl. No.: 15/700,332

(22) Filed: Sep. 11, 2017

(65) Prior Publication Data

US 2018/0022566 A1 Jan. 25, 2018

Related U.S. Application Data

(62) Division of application No. 14/048,529, filed on Oct. 8, 2013, now Pat. No. 9,758,340.

(51) Int. Cl.
*B65H 54/02* (2006.01)
*B65H 54/54* (2006.01)
(Continued)

(52) U.S. Cl.
CPC ..... *B65H 54/02* (2013.01); *B65H 19/126* (2013.01); *B65H 49/325* (2013.01);
(Continued)

(58) Field of Classification Search
CPC ..... B65H 54/02; B65H 54/54; B65H 19/126; B65H 54/026; B65H 54/12; B65H 54/553;
(Continued)

(56) References Cited

U.S. PATENT DOCUMENTS 1,307,559 A 6/1919 McNeilly
1,742,029 A 12/1929 Priester
(Continued)

FOREIGN PATENT DOCUMENTS

CN 202272591 6/2012
EP 0130473 1/1985
(Continued)

OTHER PUBLICATIONS

U.S. Office Action dated Dec. 21, 2010 in U.S. Appl. No. 12/208,232.
(Continued)

*Primary Examiner* — Michael E Gallion
(74) *Attorney, Agent, or Firm* — Hartman & Citrin LLC

(57) ABSTRACT

A capstan includes a lift motor, a flexible lifting member, and a tether assembly. The lift motor is operatively connected to a shaft. The flexible lifting member includes a first end and a second end. The first end is connected to the shaft. The flexible lifting member connects a lift assembly to the lift motor via the shaft. The tether assembly includes a switch arranged between a portion of the flexible lifting member and a portion of the capstan. The second end is connected to the tether assembly. The switch acts as a safety in case of a broken flexible lifting member and allows for an automated unloading cycle.

5 Claims, 6 Drawing Sheets

(51) Int. Cl.

| | |
|---|---|
| ***B65H 19/12*** | (2006.01) |
| ***B65H 49/32*** | (2006.01) |
| ***B65H 51/015*** | (2006.01) |
| ***B65H 54/12*** | (2006.01) |
| ***B65H 54/553*** | (2006.01) |
| ***B65H 54/74*** | (2006.01) |
| ***B65H 59/04*** | (2006.01) |
| ***B65H 59/38*** | (2006.01) |

(52) U.S. Cl.
CPC ..... *B65H 51/015* (2013.01); *B65H 54/026* (2013.01); *B65H 54/12* (2013.01); *B65H 54/54* (2013.01); *B65H 54/553* (2013.01); *B65H 54/74* (2013.01); *B65H 59/04* (2013.01); *B65H 59/385* (2013.01); *B65H 59/387* (2013.01); *B65H 2701/34* (2013.01); *Y10S 414/124* (2013.01)

(58) Field of Classification Search
CPC .... B65H 49/325; B65H 51/015; B65H 59/04; B65H 59/385; B65H 59/387; Y10S 414/124
See application file for complete search history.

(56) References Cited

U.S. PATENT DOCUMENTS 1,874,904 A * 8/1932 Crafts ..... B65H 16/06 242/559
1,888,761 A 11/1932 Foyer
1,982,642 A 12/1934 Curok
2,144,094 A 1/1939 Wood
2,579,730 A * 12/1951 Eurey ..... B62B 3/0625 254/7 R
2,641,413 A * 6/1953 Bruestle ..... B65H 54/54 242/470
2,755,066 A 7/1956 Mallasch
2,945,636 A * 7/1960 Lenk ..... B65H 54/026 242/153
2,965,333 A * 12/1960 Scott ..... B21C 47/04 242/482.7
2,988,300 A * 6/1961 Woods ..... B65H 54/02 242/156.2
3,017,450 A * 1/1962 Hicks ..... H01B 13/0257 174/34
3,103,322 A * 9/1963 Garner ..... B21C 47/28 242/470
3,223,385 A 12/1965 Sakae
3,304,060 A 2/1967 Wanless et al.
3,329,369 A * 7/1967 Guthrie ..... B65H 19/126 242/559.3
3,343,861 A * 9/1967 Leon ..... B66C 1/62 294/103.1
3,458,152 A 7/1969 Barkley et al.
3,583,743 A 6/1971 Newell
3,604,743 A 9/1971 Kinkopf
3,614,065 A 10/1971 Adamski et al.
3,687,385 A 8/1972 Skalleberg
3,758,079 A 9/1973 Workman, Jr.
3,788,575 A 1/1974 Boettcher et al.
3,810,551 A 5/1974 Bust
3,847,190 A * 11/1974 Forester ..... B21F 7/00 140/149
3,855,777 A * 12/1974 Durkee ..... B65H 51/14 242/166
3,948,462 A 4/1976 Maillefer
3,957,248 A 5/1976 Hannson
4,030,704 A 6/1977 Beierle et al.
4,068,427 A 1/1978 Camardo
4,092,012 A 5/1978 Ishigami
4,098,468 A 7/1978 Skalleberg
4,154,410 A * 5/1979 Haehnel ..... B65H 54/02 242/472.8
4,194,702 A 3/1980 Ploeg
4,200,212 A * 4/1980 Hartig ..... B65H 54/026 226/24
4,209,140 A 6/1980 Seibert
4,273,469 A 6/1981 Lunde
4,305,513 A 12/1981 Voelz
4,342,190 A * 8/1982 Ziemek ..... B65H 51/14 57/293
4,447,012 A * 5/1984 Woodruff ..... B65H 16/06 242/423.1
4,454,999 A 6/1984 Woodruff
4,495,759 A * 1/1985 Brandyberry ..... D07B 3/02 57/58.52
4,502,390 A 3/1985 Shaw
4,583,713 A 4/1986 Fukura et al.
4,590,755 A * 5/1986 Garner ..... H01B 13/0235 57/293
4,593,883 A 6/1986 Nelson
4,628,747 A 12/1986 Weitz
4,693,433 A * 9/1987 Martin ..... B60T 13/22 188/170
4,746,078 A 5/1988 Setzke
4,752,047 A 6/1988 Franks, Jr.
4,754,937 A 7/1988 Hoddinott et al.
4,789,108 A 12/1988 Recalde
4,799,981 A 1/1989 Stone
4,842,473 A 6/1989 Zbornik
4,899,945 A 2/1990 Jones
4,945,938 A 8/1990 Ponsford et al.
5,009,353 A 4/1991 Alquist
5,029,814 A 7/1991 Liegel et al.
5,033,687 A * 7/1991 Bates ..... B65H 54/553 242/129.51
5,074,528 A 12/1991 Long, Jr.
5,123,602 A 6/1992 Skalleberg et al.
5,139,751 A 8/1992 Mansfield
5,228,656 A 7/1993 Sauber
5,242,127 A * 9/1993 Jaaskelainen ..... B65H 54/54 242/557
5,246,180 A * 9/1993 Berry ..... B65H 49/32 242/129.51
5,267,702 A * 12/1993 Schumacher ..... B65H 54/553 242/129.51
5,294,066 A 3/1994 Lacour
5,308,217 A * 5/1994 Pienta ..... B21C 47/24 242/533
5,312,057 A 5/1994 Graham
5,330,122 A * 7/1994 Wood ..... B65H 54/2821 242/397.3
5,332,166 A 7/1994 Kepes
5,333,809 A 8/1994 Berry, III
5,362,196 A 11/1994 Beattle
5,378,104 A * 1/1995 Payne, Jr. ..... B65H 19/126 242/592
5,445,426 A * 8/1995 Sorensen ..... B66C 1/10 294/67.3
5,467,969 A 11/1995 Kobayashi et al.
5,562,394 A * 10/1996 Brown, Jr. ..... B66C 1/66 294/67.31
5,613,642 A * 3/1997 Mulder ..... B65H 54/02 242/472.8
5,775,079 A * 7/1998 Hoover ..... D01H 1/11 57/1 R
5,836,536 A 11/1998 Bodden
6,042,047 A 3/2000 Thievessen
6,086,009 A 7/2000 Skalleberg et al.
6,230,752 B1 5/2001 Dornier
6,299,100 B1 10/2001 Cloud
6,435,450 B1 8/2002 Shields et al.
6,457,667 B1 10/2002 Golightly et al.
6,481,661 B1 11/2002 Lauhde
6,494,397 B1 12/2002 Myklebust
6,533,248 B1 3/2003 Schafer
6,612,516 B1 9/2003 Haines
6,631,864 B1 10/2003 Skalleberg
6,669,135 B1 12/2003 Hartley
6,994,510 B2 * 2/2006 Cooke ..... B62D 65/18 414/618

(56) References Cited

U.S. PATENT DOCUMENTS

| | | | | |
|---|---|---|---|---|
| 7,040,059 | B2 | 5/2006 | Hodsdon et al. | |
| 7,077,368 | B1 | 7/2006 | Karoly | |
| 7,150,366 | B1 | 12/2006 | Zakula, Sr. | |
| 7,153,001 | B2 * | 12/2006 | Kim | F21V 21/15 362/291 |
| 7,287,717 | B2 | 10/2007 | Ropers | |
| 7,375,284 | B2 * | 5/2008 | Stutzman | H01B 11/06 174/110 R |
| 7,658,345 | B2 | 2/2010 | Wells et al. | |
| 7,721,664 | B2 | 5/2010 | Woolley | |
| 7,823,861 | B2 | 11/2010 | Krug | |
| 7,905,445 | B2 | 3/2011 | Kroger | |
| 8,025,261 | B2 | 9/2011 | Jordan et al. | |
| 8,157,113 | B2 | 4/2012 | Golder | |
| 8,191,340 | B1 | 6/2012 | Buchko | |
| 8,226,140 | B1 | 7/2012 | Dietrich | |
| 8,276,858 | B1 | 10/2012 | Jordan et al. | |
| 8,398,013 | B2 | 3/2013 | Skalleberg | |
| 8,616,529 | B2 | 12/2013 | Kim | |
| 9,079,745 | B2 | 7/2015 | Galindo Gonzalez | |
| 9,156,651 | B2 | 10/2015 | Park | |
| 9,315,244 | B2 | 4/2016 | Kalkman | |
| 9,527,707 | B1 | 12/2016 | Fehringer | |
| 9,758,340 | B1 * | 9/2017 | Reese | B65H 54/02 |
| 2003/0042352 | A1 * | 3/2003 | St Germain | B65H 19/126 242/559 |
| 2003/0074954 | A1 | 4/2003 | Engle | |
| 2005/0087644 | A1 * | 4/2005 | Kim | B65H 75/425 242/390.8 |
| 2006/0180699 | A1 * | 8/2006 | Cranston, III | B65H 16/005 242/571 |
| 2008/0217491 | A1 | 9/2008 | Kossak | |
| 2009/0134267 | A1 * | 5/2009 | Kroger | B65H 16/06 242/592 |
| 2009/0173818 | A1 * | 7/2009 | Spruell | B65H 54/026 242/470 |
| 2009/0174160 | A1 | 7/2009 | Duarte | |
| 2009/0196723 | A1 | 8/2009 | Smith et al. | |
| 2009/0224221 | A1 | 9/2009 | Monroe | |
| 2009/0322001 | A1 | 12/2009 | Luke | |
| 2010/0064823 | A1 | 3/2010 | Schlegel | |
| 2011/0226885 | A1 | 9/2011 | Fries et al. | |
| 2012/0006931 | A1 * | 1/2012 | Murata | B65H 19/126 242/578.1 |
| 2012/0067997 | A1 | 3/2012 | Ingles | |
| 2012/0223179 | A1 * | 9/2012 | Galindo Gonzalez | B65H 49/32 242/598.5 |
| 2012/0236141 | A1 * | 9/2012 | Takagawa | B65H 19/126 348/95 |
| 2013/0168484 | A1 | 7/2013 | Novotny et al. | |
| 2015/0371741 | A1 * | 12/2015 | Leggett | B65H 59/16 432/3 |
| 2016/0001996 | A1 * | 1/2016 | Howard | B65H 75/185 242/539 |

FOREIGN PATENT DOCUMENTS

| | | |
|---|---|---|
| EP | 0628507 | 12/1994 |
| GB | 1456189 | 11/1976 |
| GB | 1514439 | 6/1978 |
| GB | 2236769 | 4/1991 |
| JP | H07124643 | 5/1995 |
| JP | 2010070338 | 4/2010 |
| JP | 2010143681 | 7/2010 |
| JP | 2010143682 | 7/2010 |
| SE | 466443 | 2/1992 |
| WO | WO 92/14669 | 9/1992 |

OTHER PUBLICATIONS

U.S. Notice of Allowance dated May 12, 2011 in U.S. Appl. No. 12/208,232.

U.S. Office Action dated Jan. 12, 2012 in U.S. Appl. No. 13/230,016.

U.S. Office Action dated Jun. 4, 2014 in U.S. Appl. No. 13/408,511.

U.S. Office Action dated Oct. 8, 2014 in U.S. Appl. No. 13/408,511.

U.S. Restriction Requirement dated Aug. 12, 2015 in U.S. Appl. No. 14/048,529.

U.S. Office Action dated Oct. 27, 2015 in U.S. Appl. No. 14/048,529.

U.S. Office Action dated Jun. 2, 2016 in U.S. Appl. No. 14/048,529.

U.S. Notice of Allowance dated May 3, 2017 in U.S. Appl. No. 14/048,529.

"Storage and Material Handling" electronic brochure [retrieved version of website captured on Feb. 7, 2007, by Wayback Machine Internet archival service from Wayback Machine Internet archival service on Feb. 21, 2014], http://www.greenlee.com/cat_docs/Storage_07.pdf, 1 page.

Canadian Office Action dated Jan. 30, 2018, in Canadian Patent Application No. 2,770,055.

* cited by examiner

CAPSTAN AND SYSTEM OF CAPSTANS FOR USE IN SPOOLING MULTIPLE CONDUCTORS ONTO A SINGLE REEL

CROSS REFERENCE TO RELATED APPLICATIONS

This application is a divisional of U.S. patent application Ser. No. 14/048,529 filed Oct. 8, 2013, entitled "Capstan and System of Capstans for Use in Spooling Multiple Conductors Onto a Single Reel," now U.S. Pat. No. 9,758,340, which is herein incorporated by reference in its entirety.

BACKGROUND

Reels of a conductor (e.g., a wire or a cable) can weigh several hundred and even thousands of pounds. During manufacturing, the conductor can be wound onto a reel. Typically, a single type of conductor is wound onto a reel during manufacturing. However, customers may want multiple types of conductors to be wound onto a single reel. In addition, customers may want a conductor delivered on a different size reel, type of reel, or combination thereof than the reel used for winding the conductor during manufacturing.

BRIEF DESCRIPTION OF THE DRAWINGS

The accompanying drawings, which are incorporated in and constitute a part of this disclosure, illustrate various embodiments of the present disclosure. In the drawings.

DETAILED DESCRIPTION

Figure 1:
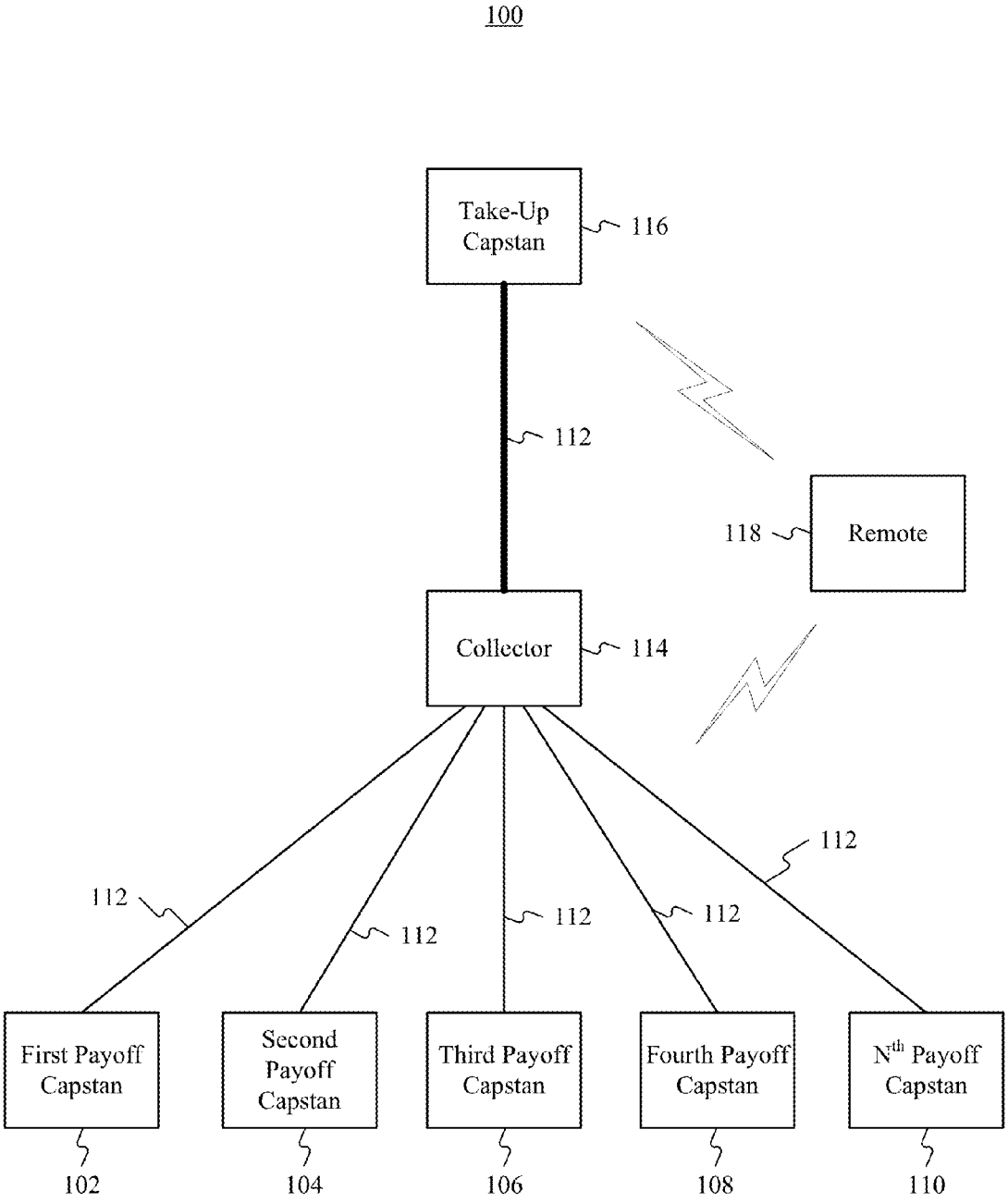
FIG. 1 shows a diagram of an operating environment for spooling multiple conductors onto a single reel, according to an illustrative embodiment.

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure.

The following description is directed to systems, methods and apparatuses for spooling a conductor from a reel on which the conductor is wound to another reel. Further embodiments are directed to systems, methods, and apparatuses for spooling multiple conductors from multiple reels onto a single reel. According to various embodiments, a capstan is provided that includes a lift motor, a flexible lifting member, and a tether assembly. The lift motor is operatively connected to a shaft. The flexible lifting member includes a first end and a second end. The first end is connected to the shaft. The flexible lifting member connects a lift assembly to the lift motor via the shaft. The tether assembly includes a switch arranged that, according to various embodiments, is between a portion of the flexible lifting member and a portion of the capstan. The second end is connected to the tether assembly.

Turning now to the figures, FIG. 1 shows a diagram of an operating environment 100 for spooling multiple conductors onto a single reel. The operating environment 100 includes multiple payoff capstans (e.g., a first payoff capstan 102, a second payoff capstan 104, a third payoff capstan 106, a fourth payoff capstan 108, and an $n^{th}$ payoff capstan 110.) Each of the payoff capstans 102-110 aids in paying off one or more conductors 112. For example, the first payoff capstan 102 may pay off a single conductor, the second payoff capstan 104 may pay off three conductors, and the remaining payoff capstans may pay off zero conductors. Likewise, each of the payoff capstans 102-110 may pay off only one conductor. Furthermore, each of the payoff capstans 102-110 may pay off two conductors.

The conductors 112 may feed through a collector 114. The collector 114 may arrange the conductors 112 to facilitate spooling. For example, as the conductors 112 pass through the collector 114, the conductors 112 may be oriented into a parallel configuration where the conductors 112 are arranged substantially parallel to one another. Furthermore, the collector 114 may provide other functions such as marking and binding the conductors 112. For instance, as the conductors 112 pass through the collector 114, the conductors 112 may be bound together with a binder. Still consistent with various embodiments, the conductors 112 may be twisted together. In addition, the conductors 112 may be marked for identification. For instance, as the conductors 112 pass through the collector 114 the conductors 112 may be marked with information such as, for example, conductor size, maximum voltage and amperage, a lot number, a job number, etc.

After passing through the collector 114, the conductors 112 may spool onto a reel associated with a take-up capstan 116. According to illustrative embodiments, the take-up capstan 116 holds a single reel. During operation, the take-up capstan 116 rotates the single reel. As the single reel rotates, the conductors 112 are pulled from their respective payoff capstans, such as the payoff capstans 102-110. The pulling of the conductors 112 assists in causing the conductors 112 to be wound tightly around the single reel.

During setup of a spooling operation, a free end of each of the conductors 112 may be connected to the single reel held by the take-up capstan 116. After connecting the free end of the conductors 112 to the single reel held by the take-up capstan 116, a majority of the conductors 112 remains wound around reels connected to the payoff capstans 102-110. For example, a reel connected to the first payoff capstan 102 may contain 1,000 feet of the conductor 112 feeding from the first payoff capstan 102. During setup, the free end of the conductor 112 feeding from the first payoff capstan 102 may be fed from the first payoff capstan 102 through the collector 114 and attached to the single reel attached to the take-up capstan 116. The same procedure can be used to connect the conductors 112 from the other payoff capstans 104-110 to the single reel. According to various embodiments one or more of the payoff capstans 102-110 aids in feeding the conductors 112 from the reels associated with the one or more payoff capstans 102-110 to the reel associated with the take-up capstan 116, as discussed further herein.

Each of the payoff capstans 102-110 can be controlled independently of one another. For example, during setup, the second payoff capstan 104 may cause the reel attached to the second payoff capstan 104 to rotate without causing reels attached to the other payoff capstans 102, 106, 108, 110 to rotate. The independent operation of each of the payoff capstans 102-110 allows for a single operator to feed the conductors 112 from the payoff capstans 102-110 one at a time. In other words, the independent operation of each of the payoff capstans 102-110 eliminates the need for multiple operators to set up the spooling operation.

The rotation of the reels attached to each of the payoff capstans 102-110 may be controlled by a drive assembly associated with each of the payoff capstans 102-110 (discussed in greater detail below with respect to FIGS. 2 and 3). The drive assemblies used to rotate the reels connected to the payoff capstan during setup of a spooling operation may also be used to fix the position of the reels. For example, after the operator has connected the free end of the conductor 112 paying off from the first payoff capstan 102, the operator may lock the drive assembly associated with the first payoff capstan 102 in a stopped position. The stopped position may hinder the ability of the reel connected to the first payoff capstan 102 to rotate.

Once the free ends of the conductors 112 have been fed from the payoff capstans 102-110 and connected to the single reel associated with the take-up capstan 116, the single reel may be rotated by the take-up capstan 116. The rotation of the single reel by the take-up capstan 116 creates a tension within the conductors 112. The tension within the conductors 112 causes the reels attached to the payoff capstans 102-110 to rotate with braking tension being provided by the drive assemblies, thus paying off the conductors 112 from the payoff capstans 102-110 under controlled tension.

The operation of the payoff capstans 102-110 and the take-up capstan 116 can be controlled by a controller (e.g., handheld remote 118 described in greater detail below with respect to FIG. 4). The handheld remote 118 can be connected directly to each of the payoff capstans 102-110 and the take-up capstan 116 by a wired or wireless connection. In addition, each of the payoff capstans 102-110 and the take-up capstan 116 may include its own handheld remote. In other words, the handheld remote 118 may control each of the payoff capstans 102-110 and the take-up capstan 116 directly, or the handheld remote 118 may control each of the payoff capstans 102-110 and the take-up capstan 116 via handheld remotes associated directly with each of the capstans (e.g., a master-slave configuration). The handheld remote 118 can control each of the payoff capstans 102-110 by communicating with a controller 237. A controller 237 is associated with each of the payoff capstans 102-110. As an example, the handheld remote 118 can act as a controller interface to allow a user to control various functions of the payoff capstans 102-110 and take-up capstan 116. Still consistent with various embodiments, each controller 237 associated with the payoff capstans 102-110 and the take-up capstan 116 can include a controller interface that can be used to control respective capstans.

During operation, a controller 237 can detect faults that may occur at any of the payoff capstans 102-110 or the take-up capstan 116. For example, the controller 237 may detect that a reel attached to the first payoff capstan 102 has become detached from the first payoff capstan 102. Other examples of faults include, but are not limited to, the conductors 112 breaking, a reel connected to one of the payoff capstans 102-110 running out of the conductor 112, excessive drag being created by one of the reels connected to one of the payoff capstans 102-110, and a tangled conductor.

In response to detecting a fault, the controller 237 may activate a brake located at each of the payoff capstans 102-110 and the take-up capstan 116 to stop reels attached to them from rotating. The brake may be a part of the drive assembly or may be a separate braking apparatus. By stopping the reels from rotating, the risk of further faults can be minimized. For example, if a reel attached to the first payoff capstan 102 becomes detached from the first payoff capstan 102, stopping the take-up capstan 116 may prevent the take-up capstan 116 from pulling the detached reel across the floor. Another example may be if there is a tangle in one of the conductors 112, halting the payoff capstans 102-110 and the take-up capstan 116 may prevent the tangle from reaching the take-up capstan 116 or damaging the conductors 112 due to excessive tension with the conductors 112.

The take-up capstan 116 may have the same or a similar design as the payoff capstans 102-110. In addition, the payoff capstans 102-110 may have similar or differing designs. For example, any one of or all of the payoff capstans 102-110 and the take-up capstan 116 can have a configuration as described below with respect to FIGS. 2 and 3. Furthermore, the collector 114 may be eliminated. For example, the conductors 112 may feed directly from the payoff capstans 102-110 to the take-up capstan 116.

Figure 2:
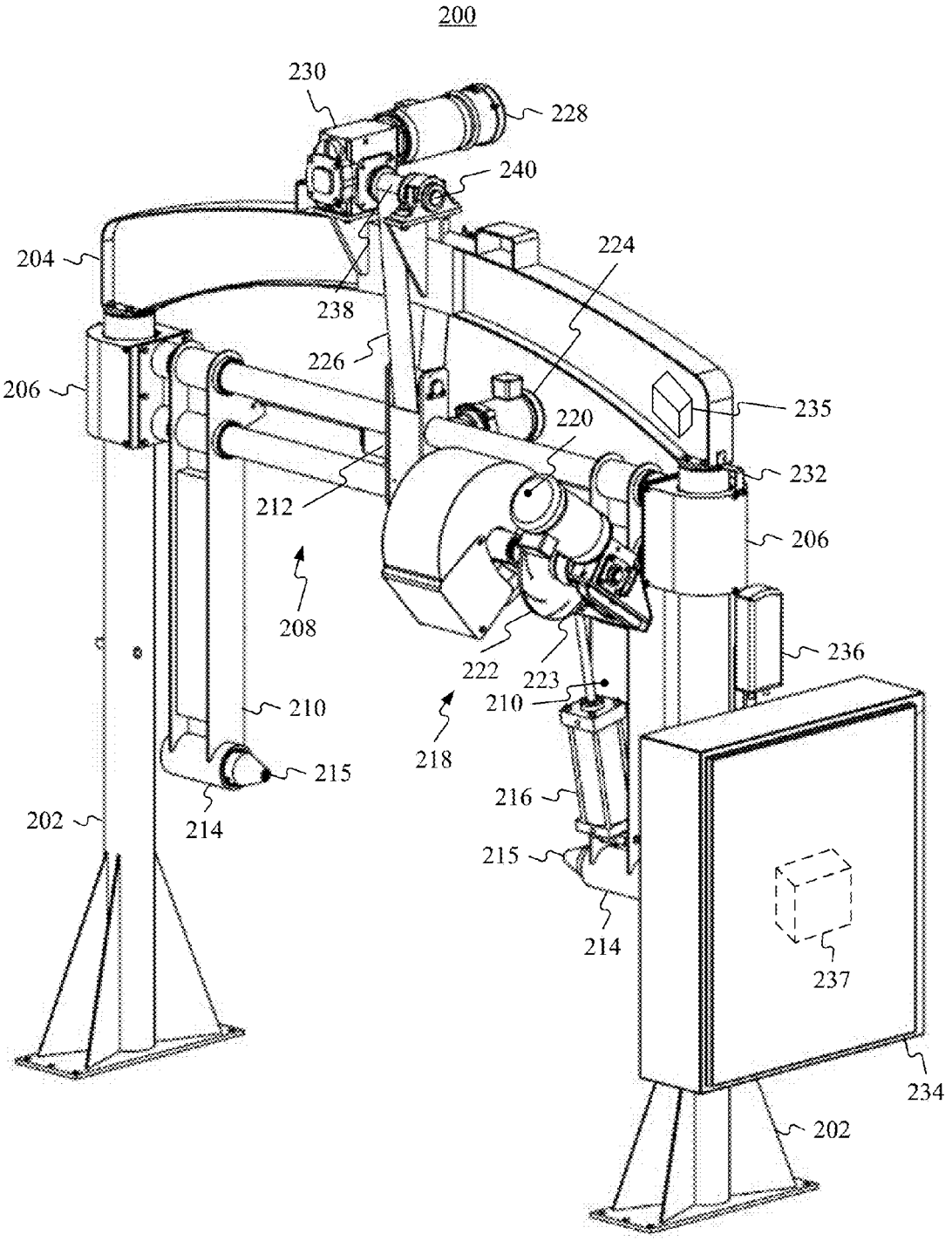
FIG. 2 shows a front perspective of a capstan, according to an illustrative embodiment.
Figure 3:
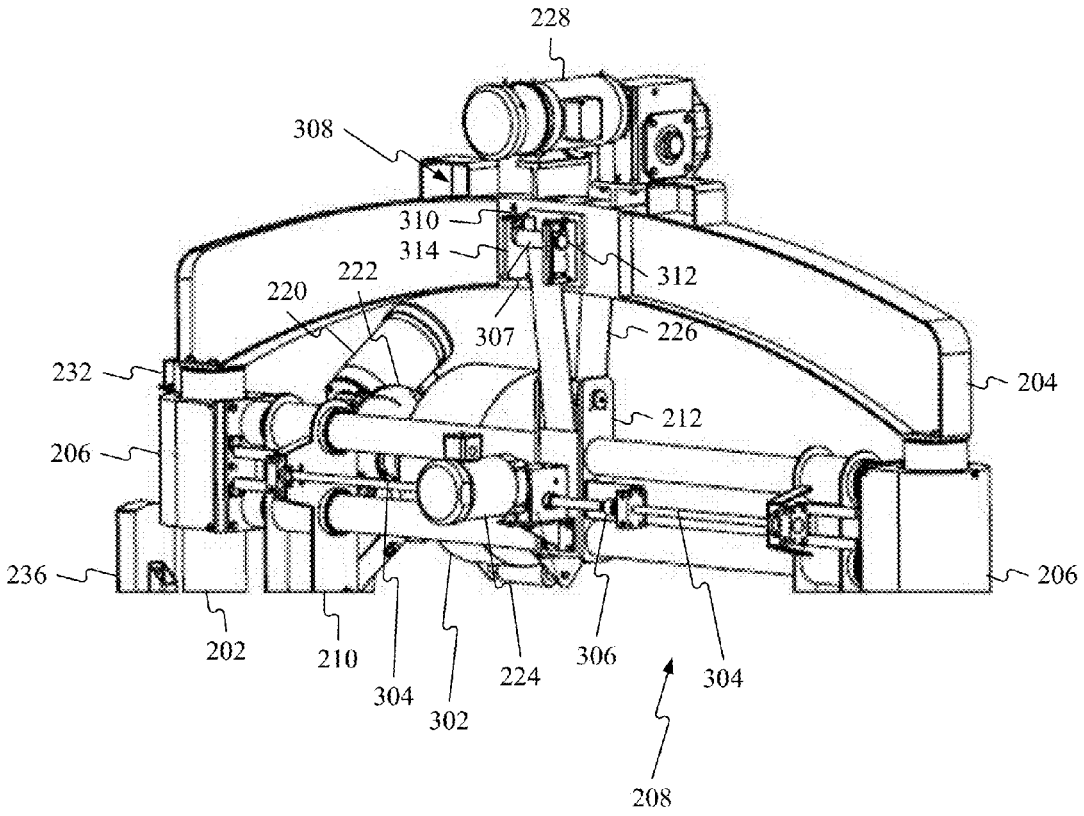
FIG. 3 shows a rear perspective of a portion of the capstan in FIG. 1, according to an illustrative embodiment.

Turning now to FIGS. 2 and 3, FIG. 2 shows a capstan 200. As described above, the capstan 200 could be any of the payoff capstans 102-110 as well as the take-up capstan 116. The capstan 200 includes posts 202 and a header 204. The posts 202 may be bolted to the floor or connected to wheels or other structures that allow the capstan 200 to be moved.

Figure 6:
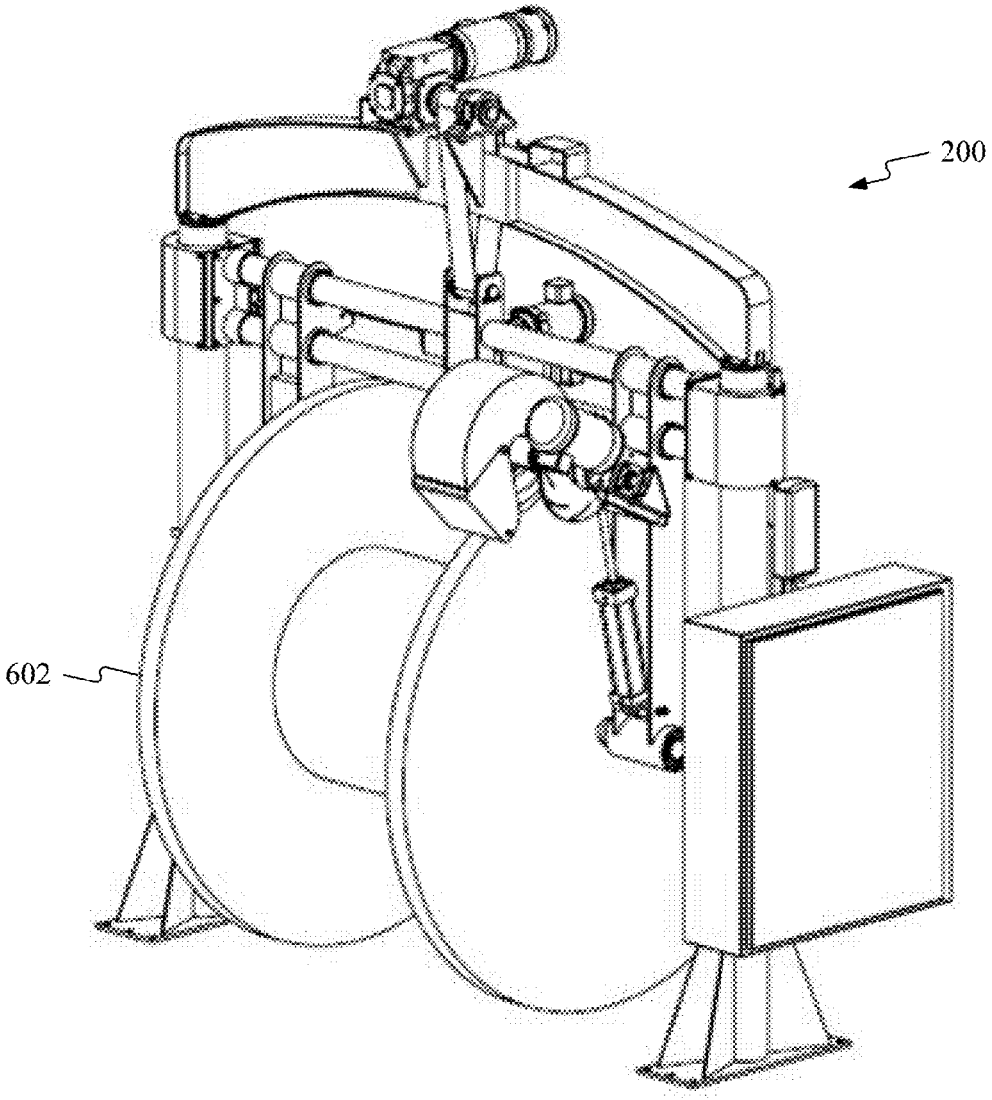
FIG. 6 shows a reel associated with a capstan.

Vertical slide assemblies 206 are connected to the posts 202 and allow for a traverse guide assembly 208 to move up and down. Attached to the traverse guide assembly 208 are arms 210 and a lift assembly 212. The arms 210 include pintle assemblies 214. The pintle assemblies 214 allow for reels to be connected to the capstan 200. FIG. 6 shows a reel 602 attached to the capstan 200. For example, pintles 215 may protrude from the pintle assemblies 214 and penetrate holes located in the center of reels.

At least one of the arms 210 includes a cylinder 216. The cylinder 216 can be hydraulic, pneumatic, or electric. Actuation of the cylinder 216 causes a drive assembly 218 to move. The drive assembly 218 may comprise a drive wheel 302 and a drive motor 220. Movement of the drive assembly 218 can cause the drive wheel 302 to engage a flange of a reel attached to the capstan 200. During setup of a spooling operation, the drive motor 220 may rotate the drive wheel 302. Rotation of the drive wheel 302 can cause the reel to rotate. In addition, to keep the reel from rotating, the drive wheel 302 may contact the reel and the drive motor 220 may act as a brake. Still consistent with various embodiments, the drive wheel 302 may be coupled to the drive motor 220 via a clutch 223. Using the clutch 223 may allow the drive wheel 302 to remain in contact with the reel, yet be disengaged from the drive motor 220. In other words, the clutch 223 may allow the drive wheel 302 to maintain contact with the reel and allow the reel to rotate freely. Furthermore, the drive assembly 218 may contain a rotor 222. The rotor 222 may act as a brake when used in conjunction with a caliper system (not shown).

A pinch motor 224 can also be connected to the traverse guide assembly 208. The pinch motor 224 can be coupled to the arms 210 via spindles 304. During setup, the pinch motor 224 may be actuated and cause the spindles 304 to rotate. Rotation of the spindles 304 causes the arms 210 to move toward one another or away from one another. Stated another way, actuation of the pinch motor 224 in a first direction causes both the arms 210 to approach one another and actuation of the pinch motor 224 in a second direction causes both the arms 210 to move away from one another. Still consistent with various embodiments, there may be two pinch motors 224, each controlling the arms 210 independently. Movement of the arms 210 towards one another and away from one another allow the capstan 200 to accommodate reels of varying width sizes. One or both of the spindles 304 may include a safety 306. The safety 306 acts to limit a pinching force the pinch motor 224 may apply to the reel. For example, the safety 306 may be configured such that if the pinch motor 224 applies a torque above a maximum torque to the spindles 304, the safety may disengage the pinch motor 224 from the spindles 304.

The lift assembly 212 can be connected to the header 204 via a flexible lifting member 226. Examples of the flexible lifting member 226 include, but are not limited to, a strap or cable. The strap includes two ends (e.g., a first end 238 and a second end 307). The first end 238 may be connected to a lift motor 228, via a shaft 240. The second end 307 may be connected to a tether assembly 308. The tether assembly 308 includes a switch 310. The switch 310 is arranged between a portion of the flexible lifting member 226 and a portion of the capstan 200 (e.g., the header 204 or another portion of the tether assembly 308).

The lift motor 228 may also include a gearbox 230. The lift motor 228 may incorporate a brake, or the gearbox 230, may act as a brake to fix the vertical position of the lift assembly 212. For example, during setup, the lift motor 228 may raise the lift assembly 212 by rotating and wrapping the first end 238 of the flexible lifting member 226 around the shaft 240. As the flexible lifting member 226 wraps around the shaft 240, the lift assembly 212 will rise toward the header 204. Once the lift assembly 212 is in a proper position, the lift motor 228 can be stopped. Once stopped, either the lift motor 228 or the gearbox 230 can act as a brake to hold the lift assembly 212 in the proper position.

The tether assembly 308 may include a pin 312 that rests on springs in a cradle 314. The second end of the flexible lifting member 226 may be connected to the pin 312. The switch 310 may be connected to the cradle 314, and the pin 312 may be able to move freely within the cradle 314. As a reel is lifted off the ground, the pin 312 may deactivate the switch 310 to indicate that a load is being placed on the lift assembly 212 that exceeds a predetermined load. For instance, the predetermined load may be the weight of the lift assembly 212, which may account for the combined weight of the lift assembly 212 and other components, such as the arms 210, pintle assemblies 214, etc. that are connected to the lift assembly 212. In other words, the spring and switch mechanism can account for the tare weight of the lift assembly 212 and other components of the capstan 200 when determining if a reel is attached to the capstan 200 and lifted off the ground.

The switch 310 acts as a safety. For example, during operation, should the reel experience a fault, such as the reel becoming detached from the capstan 200, the switch 310 may not sense the load exceeding the predetermined load. As a result, the switch 310 may send a signal, or open or close a circuit, to the controller 237. The signal can indicate the fault. Upon receiving the signal, the controller 237 can halt operation of the payoff capstans 102-110, the take-up capstan 116, and any other equipment that may be operating as part of the spooling process. The switch 310 also acts during the unloading cycle to detect when the reel has been lowered onto the floor, thus triggering an automated unloading sequence.

Example switches, such as the switch 310, include, but are not limited to, pressure switches, toggle switches, proximity switches and optical switches. The switch 310 can be responsive to a breaking of the flexible lifting member 226. For example, should the flexible lifting member 226 break and the reel fall to the floor, the switch 310 may send a signal to the controller 237 that the load placed on the switch is below the predetermined load and halt all machines operating as part of the spooling operation.

An upper limit proximity bracket 232 may be connected to one of the posts 202. The upper limit proximity bracket 232 acts to limit the upward travel of the lift assembly 212. For example, as the lift assembly 212 reaches a maximum height, one of the vertical slide assemblies 206 may contact the upper limit proximity bracket 232. Upon contacting the upper limit proximity bracket 232 a signal may be sent to the controller 237 to stop the lift motor 228.

The capstan 200 can also include a control enclosure 234 and a pneumatic enclosure 235. The pneumatic enclosure 235 can contain pneumatic components used to manipulate the various components of capstan 200. Consistent with various embodiments, the control enclosure 234 may include the controller 237. Still consistent with various embodiments, the control enclosure 234 may include components needed to communicate with the handheld remote 118 when the handheld remote 118 is remote from the capstan 200. For example, the handheld remote 118 may be remote from the capstan 200 and components located within the control enclosure 234 may communicate with the handheld remote 118 via a receiver 236 (e.g., a wireless network card or radio receiver).

Figure 4:
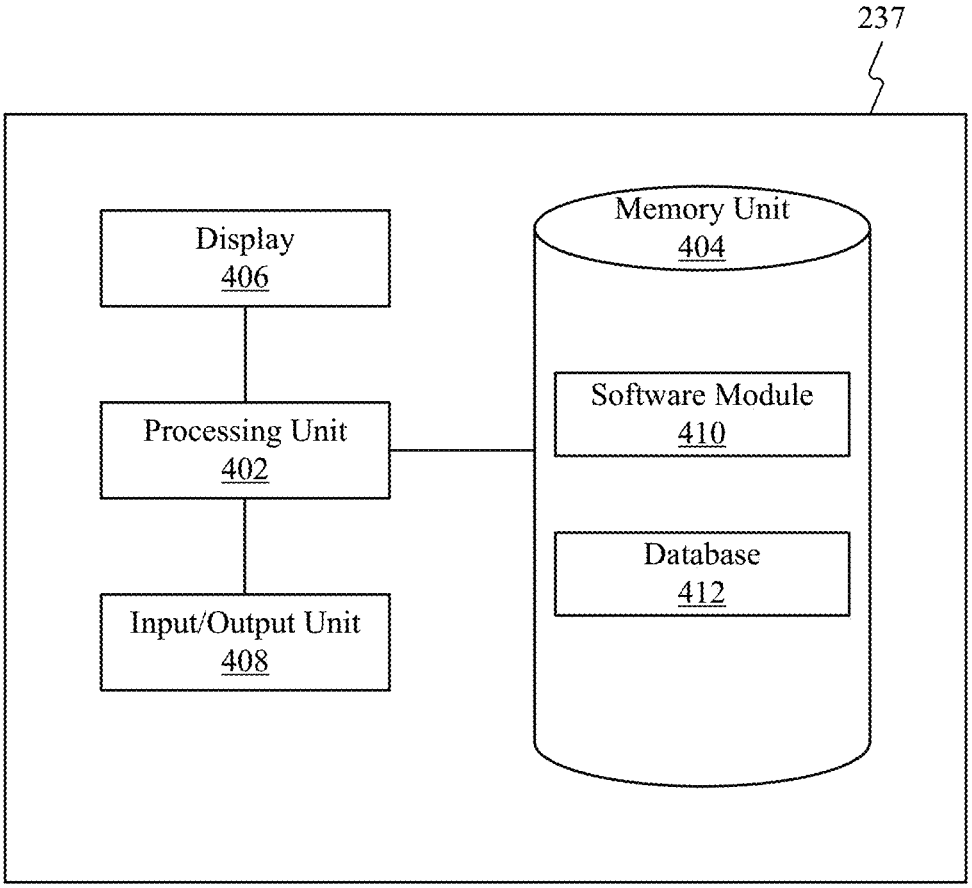
FIG. 4 shows a schematic of a controller, according to an illustrative embodiment.

FIG. 4 shows a schematic of the controller 237. The controller 237 can include a processing unit 402, a memory unit 404, a display 406, and an input/output unit 408. The memory unit 404 may include a software module 410 and a database 412. While executing on the processing unit 402, the software module 410 may perform processes for operating one or more capstans, such as capstan 200, during the spooling of multiple conductors onto a single reel as described herein.

The controller 237 can be implemented using a personal computer, a network computer, a mainframe, a smartphone, or other similar computer-based system. The controller 237 can also be configured to transmit data to and from other controllers and control interfaces. For instance, if there is a fault detected while spooling multiple conductors onto a single reel, the controller 237 can transmit a halt command to other capstans as well as provide an alarm (visual and audio) to an operator.

The controller 237 can include any computer operating environment, such as hand-held devices, multiprocessor systems, microprocessor-based or programmable sender electronic devices, minicomputers, mainframe computers, etc. The controller 237 can also be practiced in distributed computing environments where tasks are performed by remote processing devices. Furthermore, the controller 237 or handheld remote 118 may include a mobile terminal, such as a smart phone, a cellular telephone, a cellular telephone utilizing wireless application protocol (WAP), personal digital assistant (PDA), intelligent pager, portable computer, a hand held computer, or a wireless fidelity (Wi-Fi) access point. The aforementioned systems and devices are examples, and one skilled in the art will appreciate that the controller 237 or handheld remote 118 can include other systems or devices.

Figure 5:
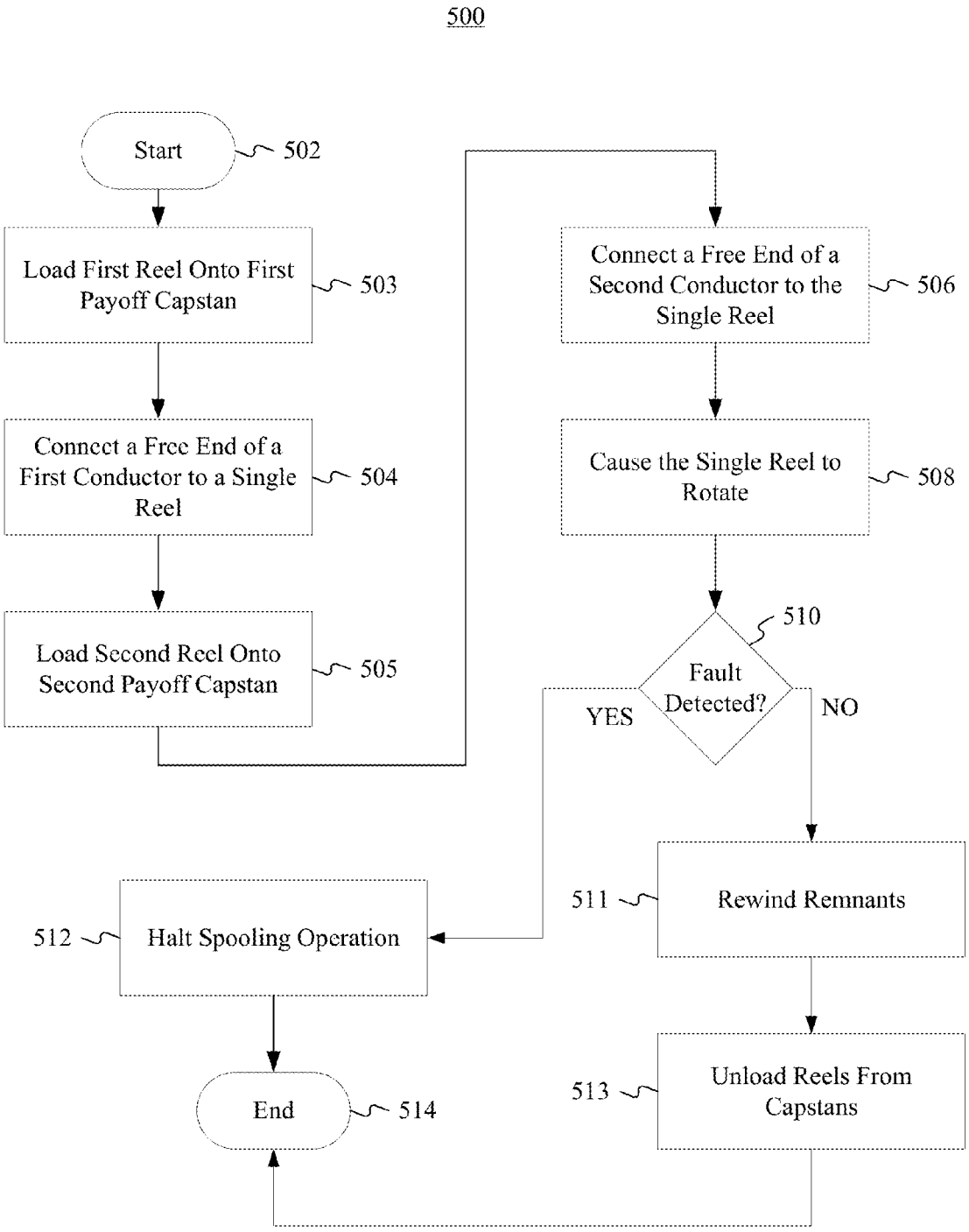
FIG. 5 shows a flowchart for a method for spooling multiple conductors onto a single reel, according to an illustrative embodiment.

FIG. 5 shows a flowchart for a method 500 for spooling multiple conductors onto a single reel, according to an illustrative embodiment. The method 500 starts at starting block 502 and proceeds to stage 503 where a first reel associated with the first payoff capstan 102 is loaded onto the first payoff capstan using the lifting mechanism previously described. After the first reel is loaded, the method 500 proceeds to step 504 where the first reel associated with the first payoff capstan 102 is rotated by the drive assembly 218 associated with the first payoff capstan 102, to aid in connecting a first end of a first conductor 112 wound on the first reel to a single reel associated with the take-up capstan 116. After connecting the free end to the single reel, the drive assembly 218 of the first payoff capstan 102 is stopped and a majority of the first conductor 112 remains wound around the first reel associated with the first payoff capstan 102. After the first end of the first conductor 112 is connected to the take-up capstan 116, a brake may be activated to keep the first reel associated with the first payoff capstan 102 from rotating.

From stage 504, the method 500 proceeds to stage 505 where a second reel is loaded onto a second payoff capstan 104 using the lifting mechanism previously described. After the second reel is loaded, the method 500 proceeds to step 506 where the second reel associated with the second payoff capstan 104 is rotated, by the drive assembly 218 associated with the second payoff capstan 104, to aid in connecting a first end of a second conductor 112 wound on the second reel to the single reel associated with the take-up capstan 116. After connecting the free end to the single reel, the drive assembly 218 of the second payoff capstan 104 is stopped and a majority of the second conductor 112 remains wound around the second reel associated with the second payoff capstan 104. Connecting the free end of the second conductor 112 associated with the second payoff capstan 104 to the single reel associated with the take-up capstan 116 can occur without rotating the first reel associated with the first payoff capstan 102.

Once all the free ends of reels associated with the payoff capstans 102-110 are attached to the single reel associated with the take-up capstan 116, the method 500 proceeds from stage 506 to stage 508 where the single reel associated with the take-up capstan 116 is rotated. The rotation of the single reel associated with the take-up capstan 116 causes the first reel and the second reel to rotate due to tension created within the first conductor and the second conductor. Variable braking is applied during this step such that the conductors 112 are wound onto the take-up reel under controlled tension.

From stage 508, the method 500 proceeds to decision block 510 where the controller 237 can detect a fault. As described herein, examples of faults, include, but are not limited to, tangled conductors, excessive drag on a reel, a reel becoming detached from a capstan, etc.

If a fault is detected, the method proceeds from decision block 510 to stage 512, where the spooling operation is halted. Halting the spooling operation includes activating a brake, associated with each of the first payoff capstan 102, the second payoff capstan 104, and the take-up capstan 116 to stop the first reel, the second reel, and the single reel from rotating. After halting the spooling operation, the method 500 terminates at termination block 514.

If no fault is detected, the method 500 may proceed to stage 511 where remnants of the conductors 112 may be rewound to the reels associated with the payoff capstans 102-110. For example, after the conductors 112 have been wound to the single reel, portions of the conductors 112 may remain on the reels associated with the payoff capstans 102-110. The remaining conductors 112 can be rewound on the reels associated with the payoff capstans 102-110. To rewind the remnants, the drive assemblies 218 associated with each of the payoff capstans 102-110 can be operated in reverse. Operating the drive assemblies 218 in reverse can cause the reels associated with each of the payoff capstans 102-110 to rotate in a direction that causes the remnants to be rewound onto the reels.

Once the remnants of the conductors 112 have been rewound, the method 500 may proceed to stage 513 where the reels associated with each capstan, payoff and take-up, are unloaded from respective capstans. For example, after the conductors 112 have been collected at the take-up capstan 116, an operator using the handheld remote 118 can start an automated sequence. The automated sequence can cause the capstans, both take-up capstan 116 and the plurality of payoff capstans 102-110, to lower reels associated with each capstan to the ground. As described above, the controller 237 of each of the payoff capstans 102-110 can utilize the switch 310 of each of the payoff capstans to determine when the reels have been lowered to the floor. Once the reels are on the ground, they may be disconnected from the capstans. After the reels have been lowered to the floor, the method 500 terminates at termination block 514.

While certain embodiments of the disclosure have been described, other embodiments may exist. While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as examples for embodiments of the disclosure.

What is claimed is:

1. A method for spooling multiple conductors onto a single reel associated with a take-up capstan, the method comprising:

connecting a free end of a first conductor to the single reel associated with the take-up capstan, wherein a majority of the first conductor is wound around a first reel connected to a first capstan;

connecting a free end of a second conductor to the single reel associated with the take-up capstan, wherein a majority of the second conductor is wound around a second reel connected to a second capstan, and wherein connecting the free end of the second conductor to the single reel occurs without rotating the first reel; and causing the single reel to be rotated by the take-up capstan, wherein rotation of the single reel by the take-up capstan causes the first reel and the second reel to rotate due to tension created within the first conductor and the second conductor, and wherein the take-up capstan halts rotation of the single reel in response to receiving, by a controller of the take-up capstan, a signal from a switch of the take-up capstan, the signal indicating that a load detected by the switch is below a predetermined load.

2. The method of claim 1, wherein connecting the free end of the second conductor to the single reel without rotating the first reel comprises rotating the second reel via a drive assembly connected to the second capstan.

3. The method of claim 1, wherein connecting the free end of the second conductor to the single reel without rotating the first reel comprises fixing a position of the first reel.

4. The method of claim 1, further comprising:

detecting, via the controller, a fault within the first capstan or the second capstan; and in response to detecting the fault, activating a brake located at each of the first capstan, the second capstan, and the take-up capstan to stop the first reel, the second reel, and the single reel from rotating.

5. The method of claim 1, wherein an automated unloading sequence is triggered in response to the switch detecting when the single reel is lowered to a floor.

* * * * *